US010872756B2

(12) United States Patent
Kim et al.

(10) Patent No.: US 10,872,756 B2
(45) Date of Patent: Dec. 22, 2020

(54) MICROWAVE DISCHARGE LAMP

(71) Applicant: Maltani Corporation, Seoul (KR)

(72) Inventors: Jin Joong Kim, Seoul (KR); Kyoung-Shin Kim, Hwaseong-si (KR); Hyun-Sung Yoon, Bucheon-si (KR)

(73) Assignee: Maltani Corporation, Seoul (KR)

( * ) Notice: Subject to any disclaimer, the term of this patent is extended or adjusted under 35 U.S.C. 154(b) by 0 days.

(21) Appl. No.: 16/640,640

(22) PCT Filed: Aug. 13, 2018

(86) PCT No.: PCT/KR2018/009241
§ 371 (c)(1),
(2) Date: Feb. 20, 2020

(87) PCT Pub. No.: WO2019/045316
PCT Pub. Date: Mar. 7, 2019

(65) Prior Publication Data

US 2020/0357628 A1 Nov. 12, 2020

(30) Foreign Application Priority Data

Aug. 30, 2017 (KR) ..... 10-2017-0110078

(51) Int. Cl.
*H01J 65/04* (2006.01)
*H01J 9/00* (2006.01)
*H01J 19/80* (2006.01)

(52) U.S. Cl.
CPC ..... *H01J 65/044* (2013.01)

(58) Field of Classification Search
None
See application file for complete search history.

(56) References Cited

U.S. PATENT DOCUMENTS 4,498,029 A * 2/1985 Yoshizawa ..... H01J 61/54 313/231.31
4,975,625 A * 12/1990 Lynch ..... H01J 65/044 315/248

(Continued)

FOREIGN PATENT DOCUMENTS

JP 2001133221 A 5/2001
JP 2005276774 A 10/2005

(Continued)

OTHER PUBLICATIONS

International Search Report and Written Opinion, International Application No. PCT/KR2018/009241, dated Nov. 29, 2018; 10 pgs.

*Primary Examiner* — Amy Cohen Johnson
*Assistant Examiner* — Srinivas Sathiraju
(74) *Attorney, Agent, or Firm* — Andrew D. Fortney; Central California IP Group, P.C.

(57) ABSTRACT

A microwave discharge lamp includes a discharge bulb which is discharged by a microwave and emits a light, a cylindrical resonant cavity which has at least a portion formed of a conductive mesh of net structure and is disposed to cover the discharge bulb, a main antenna which has one end supplied with microwave power through a bottom surface of the resonant cavity and the other end electrically contacting a side surface of the resonant cavity to be grounded, and a dummy antenna which has one end electrically grounded to the bottom surface of the resonant cavity and the other end electrically grounded to the side surface of the resonant cavity and is disposed opposite to the main antenna to be symmetrical to the main antenna about a central axis of the resonant cavity.

15 Claims, 12 Drawing Sheets

(56) References Cited

U.S. PATENT DOCUMENTS 5,905,342 A * 5/1999 Mimasu ..... H01J 61/34 313/25
6,465,959 B1 * 10/2002 Tian ..... C03C 1/008 313/110
6,476,557 B1 * 11/2002 Leng ..... H01J 61/12 313/161
8,344,625 B2 * 1/2013 Espiau ..... H01J 65/044 315/39
8,957,593 B2 * 2/2015 Brockett ..... H01J 65/042 315/248
9,117,648 B2 * 8/2015 Pothoven ..... H01J 65/044
9,177,779 B1 * 11/2015 Brockett ..... H01J 65/042
9,214,329 B2 * 12/2015 Calame ..... H01J 65/042
9,281,176 B2 * 3/2016 Kim ..... H01J 65/044
9,396,924 B2 * 7/2016 Neate ..... H01J 65/044
9,648,718 B2 * 5/2017 Kato ..... H01J 65/044
9,734,990 B2 * 8/2017 Chang ..... H01J 37/3211
9,957,610 B2 * 5/2018 Tachibana ..... H01L 21/205
9,960,011 B2 * 5/2018 Lee ..... H01J 37/30
2003/0168982 A1 * 9/2003 Kim ..... H01J 61/35 313/634
2004/0108815 A1 * 6/2004 Ukegawa ..... H01J 65/044 313/637
2007/0210052 A1 * 9/2007 Kanechika ..... H01J 65/044 219/268
2007/0222352 A1 * 9/2007 DeVincentis ..... H01J 65/044 313/231.71
2009/0284166 A1 * 11/2009 DeVincentis ..... H01J 65/044 315/248
2010/0060167 A1 * 3/2010 Neate ..... H01J 61/302 315/39
2010/0148669 A1 * 6/2010 DeVincentis ..... H01J 65/046 315/34
2010/0270920 A1 * 10/2010 Neate ..... H01J 65/044 313/607
2012/0119648 A1 * 5/2012 Neate ..... H05B 41/2806 315/39
2012/0212128 A1 * 8/2012 DeVincentis ..... H01J 65/044 315/34
2014/0132152 A1 * 5/2014 Kim ..... H01J 65/044 315/34
2014/0132153 A1 * 5/2014 Kim ..... H01J 7/46 315/39
2014/0167607 A1 * 6/2014 Kang ..... H01J 65/044 315/39
2015/0155155 A1 * 6/2015 Kim ..... H01P 1/173 315/39
2015/0371842 A1 * 12/2015 Park ..... G21F 7/03 315/34
2019/0139753 A1 * 5/2019 Skinner ..... H01J 23/34

FOREIGN PATENT DOCUMENTS

JP 2011060505 A 3/2011
KR 100464058 B1 1/2005
KR 101880747 B1 * 7/2018 ..... H01J 65/044
WO WO-2019045316 A1 * 3/2019 ..... H01J 65/044

* cited by examiner

MICROWAVE DISCHARGE LAMP

CROSS-REFERENCE TO RELATED APPLICATIONS

This application is a continuation of and claims priority to PCT/KR2018/009241 filed on Aug. 13, 2018, which claims priority to Korea Patent Application No. 10-2017-0110078 filed on Aug. 30, 2017, the entireties of which are both hereby incorporated by reference.

TECHNICAL FIELD

The present disclosure relates to plasma discharge lamps using a microwave and, more particularly, to a microwave discharge lamp which directly provides a microwave to a resonant cavity.

BACKGROUND

Since a conventional high-power high-intensity discharge (HID) lamp uses an electrode, its life is short and its flux is rapidly reduced as a life end phenomenon. In addition, since the conventional power-high HID lamp uses mercury (Hg) which is one of the main causes of environmental pollution, it is not environment-friendly (or eco-friendly).

To overcome the above disadvantages, high-power microwave HID lamps have emerged. A conventional high-power microwave HID lamp uses a cylindrical waveguide TE11 mode, which is a lowest basic mode, in a cylindrical waveguide. Accordingly, a spherical lamp is inserted in a cylindrical waveguide, the form of a plasma is determined according to the form of an electric field of the TE11 mode, and the cylindrical waveguide TE11 mode causes oval discharge. As a result, in the case of high-power discharge, a plasma causes local heating of the spherical lamp and thus the spherical lamp is easily ruptured.

A method of mechanically rotating the spherical lamp and a method of rotating an electric field applied to the spherical lamp according to time have been proposed to prevent the rupture caused by local heating.

The method of mechanically rotating a spherical lamp uses a motor to rotate the spherical lamp itself in a light bulb. The method of mechanically rotating a spherical lamp suffers from disadvantages such as reduction in component life, rupture of a bulb when the rotation of a lamp is stopped, structural complexity associated with the use of additional components, and additional cost. In addition, the spherical bulb is vulnerable to shock. Thus, the cost for maintenance increases.

The method of rotating an electric field applied to a spherical lamp according to time does not require rotation of the spherical lamp. However, an additional component is required to fix the spherical lamp.

SUMMARY

Example embodiments of the present disclosure provide a compact microwave discharge lamp.

A microwave discharge lamp according to an example embodiment of the present disclosure includes: a discharge bulb which is discharged by a microwave and emits a light; a cylindrical resonant cavity which has at least a portion formed of a conductive mesh of net structure and is disposed to cover the discharge bulb; a main antenna which has one end supplied with microwave power through a bottom surface of the resonant cavity and the other end electrically contacting a side surface of the resonant cavity to be grounded; and a dummy antenna which has one end electrically grounded to the bottom surface of the resonant cavity and the other end electrically grounded to the side surface of the resonant cavity and is disposed opposite to the main antenna to be symmetrical to the main antenna about a central axis of the resonant cavity.

In example embodiments, the resonant cavity may include: a bottom resonant cavity which has a bottom surface into which the main antenna is inserted, is formed of a conductive material, and has an opened top surface; and a top resonant cavity which is coupled with the top surface of the bottom resonant cavity and has a side surface and a top surface formed of a conductive mesh. The discharge bulb may be disposed at the top resonant cavity.

In example embodiments, the discharge bulb may include: a top pillar extending in a center direction of the top resonant cavity to be fixed to the top resonant cavity; and a bottom pillar extending in a center direction of the bottom resonant cavity to be fixed to the bottom resonant cavity.

In example embodiments, the microwave discharge lamp may further include: a microwave power supply which supplies microwave power to the main antenna; and a transmission line of a coaxial cable structure which transmits the microwave power of the microwave power supply to the main antenna.

In example embodiments, the microwave discharge lamp may further include: a reflection plate disposed at the boundary between the top resonant cavity and the top resonant cavity. The reflection plate may have a through-hole formed in its center. The bottom pillar may extend through the through-hole of the reflection plate, and one side of the reflection plate facing the discharge bulb may have a dielectric multilayer reflective structure to reflect light emitted from the discharge bulb.

In example embodiments, the resonant cavity may provide a circular TM010 mode or a circular TM011 mode.

In example embodiments, a frequency band of the microwave may be 2.45±0.05 GHz.

In example embodiments, the discharge bulb may be cylindrical or elliptical.

In example embodiments, the top resonant cavity may include: a cylindrical conductive ring which is formed of a conductive material and is inserted in an outer circumferential surface of the bottom resonant cavity to be in electric contact with the bottom resonant cavity; and a mesh cylinder which is fixed to the conductive ring.

A microwave discharge lamp according to an example embodiment of the present disclosure includes: a discharge bulb which is discharged by a microwave and emits a light; a cylindrical resonant cavity which has at least a portion formed of a conductive mesh of net structure and is disposed to cover the discharge bulb; and a microwave generator which directly radiates a microwave to the center of a bottom surface of the resonant cavity. The resonant cavity includes: a bottom resonant cavity whose bottom surface has the center in which an antenna of the microwave generator is inserted and which is formed of a conductive material and has an opened top surface; and a top resonant cavity which is coupled with a top surface of the bottom resonant cavity and has a side surface and a top surface formed of a conductive mesh.

In example embodiments, the microwave generator may be a magnetron.

In example embodiments, the resonant cavity may create a circular TM010 mode or a circular TM011 mode.

In example embodiments, the discharge bulb may include: a top pillar extending in a center direction of the top resonant cavity to be fixed to the top resonant cavity; and a bottom pillar extending in a center direction of the bottom resonant cavity to be fixed to the bottom resonant cavity.

In example embodiments, the microwave discharge lamp may further include: a reflection plate disposed at the boundary between the top resonant cavity and the top resonant cavity. The reflection plate may have a through-hole formed in its center, the bottom pillar may extend through the through-hole of the reflection plate, and one side of the reflection plate facing the discharge bulb may have a dielectric multilayer reflective structure to reflect light emitted from the discharge bulb.

In example embodiments, the top resonant cavity may include: a cylindrical conductive ring which is formed of a conductive material and is inserted in an outer circumferential surface of the bottom resonant cavity to be in electric contact with the bottom resonant cavity; and a mesh cylinder which is fixed to the conductive ring.

BRIEF DESCRIPTION OF THE DRAWINGS

The present disclosure will become more apparent in view of the attached drawings and accompanying detailed description. The embodiments depicted therein are provided by way of example, not by way of limitation, wherein like reference numerals refer to the same or similar elements. The drawings are not necessarily to scale, emphasis instead being placed upon illustrating aspects of the present disclosure.

DETAILED DESCRIPTION

Figure 1:
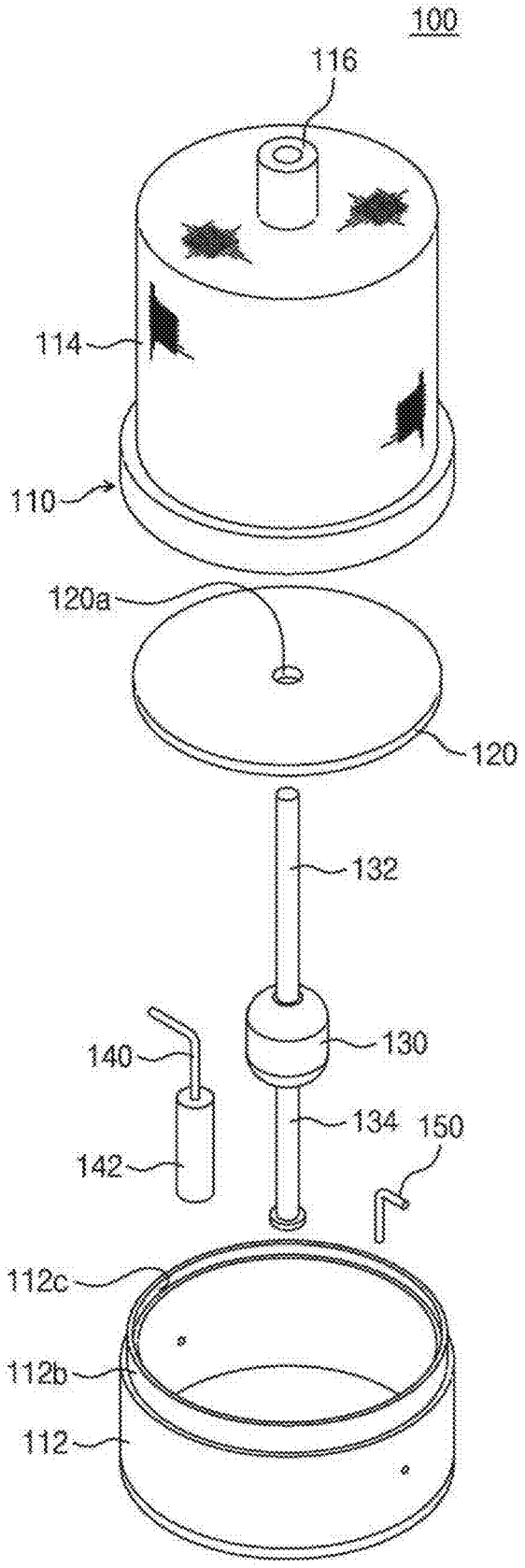
FIG. 1 is an exploded perspective view of a microwave discharge lamp according to an example embodiment of the present disclosure.

There is a requirement for a microwave discharge lamp which does not rotate an electric field according to time, does not mechanically rotate a discharge lamp, and has a simple structure.

According to an example embodiment of the present disclosure, a stable microwave discharge lamp may be provided when an external microwave power is directly supplied into a resonant cavity through a loop antenna and a dummy antenna is disposed symmetrically with respect to the loop antenna to secure symmetry and achieve impedance matching.

According to an example embodiment of the present disclosure, a TM010 or TM011 mode is created by directly inserting an antenna in a resonator. Thus, an electromagnetic wave transmission device or component such as a connection waveguide may be removed. In addition, loss caused by component-coupling impedance mismatch or during transmission of an electromagnetic wave may be suppressed to significantly increase optical emission efficiency. With the removal of the component such as waveguide, the volume of the entire system may be reduced and economic value may be improved.

Example embodiments will now be described more fully with reference to the accompanying drawings, in which some example embodiments are shown. Example embodiments may, however, be embodied in many different forms and should not be construed as being limited to the embodiments set forth herein; rather, these example embodiments are provided so that this disclosure will be thorough and complete, and will fully convey the scope of example embodiments of the present disclosure to those of ordinary skill in the art. In the drawings, the thicknesses of layers and regions are exaggerated for clarity. Like reference characters and/or numerals in the drawings denote like elements, and thus their description may be omitted.

FIG. 1 is an exploded perspective view of a microwave discharge lamp according to an example embodiment of the present disclosure.

Figure 2:
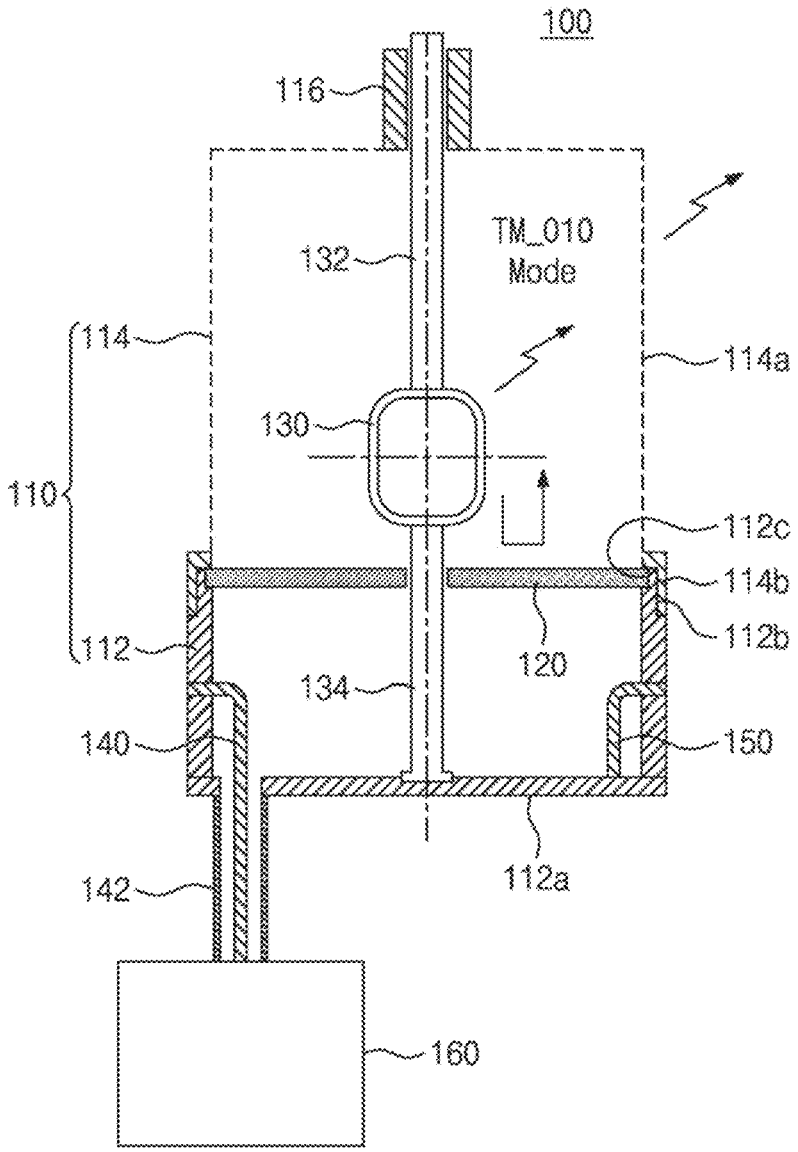
FIG. 2 is a cross-sectional view of the microwave discharge lamp in FIG. 1.

FIG. 2 is a cross-sectional view of the microwave discharge lamp in FIG. 1.

Referring to FIGS. 1 and 2, a microwave discharge lamp 100 includes a discharge bulb 130 which is discharged by a microwave and emits a light, a cylindrical resonant cavity 110 which has at least a portion formed of a conductive mesh of net structure and is disposed to cover the discharge bulb 130, a main antenna 140 which has one end supplied with microwave power through a bottom surface of the resonant cavity 110 and the other end electrically contacting a side surface of the resonant cavity 110 to be grounded, and a dummy antenna 150 which has one end electrically grounded to the bottom surface of the resonant cavity 110 and the other end electrically grounded to the side surface of the resonant cavity 110 and is disposed opposite to the main antenna 140 to be symmetrical to the main antenna 140 about a central axis of the resonant cavity 110.

The resonant cavity 110 includes a bottom resonant cavity 112 which is formed of a conductive material and has an opened top surface and a top resonant cavity 114 which is coupled with the top surface of the bottom resonant cavity 112 and has a side surface and a top surface formed of a conductive mesh. The discharge bulb 130 is disposed at the top resonant cavity 114. The main antenna 140 may be inserted through the bottom surface of the bottom resonant cavity 112 and be bent to be electrically grounded to a side surface of the bottom resonant cavity 112.

The resonant cavity 110 may create a circular TM010 mode or a circular TM011 mode. The resonant cavity 110 may be generally in the form of a cylinder. The resonant cavity 110 may include a bottom resonant cavity 112 which is formed of a conductive material and has an opened top surface and a top resonant cavity 114 which is coupled to the top surface of the bottom resonant cavity 112 and has a side surface and a top surface formed of a conductive mesh. A length of the top resonant cavity 114 may be half or three quarters of the whole length H of the resonant cavity 110. The whole length H of the resonant cavity 110 may be 90 millimeters (mm). A diameter of the resonant cavity 110 may be 91 mm. A length of the top resonant cavity 114 may be 62 mm. The top resonant cavity 114 may include a cylindrical conductive ring 114*b* which is formed of a conductive material and is inserted in an outer circumferential surface of the bottom resonant cavity 114 to be in electric contact with the bottom resonant cavity 114 and a mesh cylinder 114*a* coupled with the conductive ring 114*b*. A side surface and a top surface of the mesh cylinder 114*a* may be formed of a mesh or a porous sheet material to electrically constitute the resonant cavity 110 and transmit a light emitted from the discharge bulb 130. A lower side of the mesh cylinder 114*a* may be fixed to the conductive ring 114*b* through welding or the like.

The bottom resonant cavity 112 may be in the form of a metallic cylinder and have an outer step 112*b* formed on a top outer surface and an inner step 112*c* formed on a top inner surface. The outer step 112*b* may be inserted in a lower portion of the top resonant cavity 114. A height of the bottom resonant cavity 112 may be 28 mm. A dielectric reflection plate 120 may be disposed at the inner step 112*c*. A bottom surface 112*a* of the bottom resonant cavity 112 is closed. The reflection plate 120 may reflect a light, which impinges on the reflection plate 120 after being reflected from the discharge bulb 130, in a direction of the top resonant cavity 114.

The discharge bulb 130 may be elliptical, spherical or cylindrical. The discharge bulb 130 may be a transparent dielectric. For example, The discharge bulb 130 may be formed of quartz filling a discharge material therein. The discharge material may include at least one of sulfur, selenium, mercury, and metal halide. The discharge material may further include a buffer gas such as an argon gas. When the discharge bulb 130 is cylindrical, a diameter of the discharge bulb 130 may be 5 mm.

The discharge bulb 130 may include a top pillar 132 extending in a central axis direction of the top resonant cavity 100 to be fixed to a top surface of the top resonant cavity 114 and a bottom pillar extending in a central axis direction of the bottom resonant cavity 112 to be fixed to a bottom surface of the bottom resonant cavity 112. The top pillar 132 and the bottom pillar 134 may be formed of the same material as the discharge bulb 130 and be fused to upper and lower portions of the discharge bulb 130, respectively. The top pillar 132 may be inserted in a support 116, which extends in the center of the top surface of the top resonant cavity 114 in a central axis direction, to be fixed. A lower end of the bottom pillar 134 may be inserted in a groove, which is formed in the center of the bottom surface of the bottom resonant cavity 112, to be aligned.

The main antenna 140 may protrude adjacent to the side surface of the bottom resonant cavity 112 through the bottom surface 112*a* of the bottom resonant cavity 112. The main antenna 140 may be bent to be grounded to the side surface of the bottom resonant cavity 112. A position where the main antenna 140 is grounded may be about a quarter point of the overall resonant cavity. The position where the main antenna 140 is grounded may limit a length of the bottom resonant cavity 112. The main antenna 140 may be supplied with a microwave power via a transmission line such as a coaxial cable. A frequency band of the microwave provided via the main antenna 140 may be 2.45±0.05 GHz. The main antenna 140 may constitute a loop antenna, and created modes or electric field patterns may be different from each other according to a shape of the loop antenna. The main antenna 140 may extend by about 20 mm in a central axis direction and be bent by 90 degrees to have a structure of 3 mm outer radial direction. In this case, the TM010 mode may be created, a problem of impedance matching may be minimized, and a pattern of an electric field may be symmetrical. A mode of the resonant cavity 110 may change into the TM011 mode.

A microwave power supply 160 may transmit a microwave to the main antenna 140 via a coaxial cable 162. The microwave power supply 160 may be a solid-state microwave generator using a semiconductor device.

The dummy antenna 150 may be disposed opposite to the main antenna 140 about the central axis of the resonant cavity 110 such that they face each other. One end of the dummy antenna 150 may be disposed at the edge of the bottom surface of the bottom resonant cavity 112, and the other end of the dummy antenna 150 may be disposed on the side surface of the bottom resonant cavity 112. When the dummy antenna 150 does not exist, it is difficult to achieve impedance matching and create a stable TM010 mode. The dummy antenna 150 is disposed symmetrically to the main antenna 140 about a central axis with the same shape. The dummy antenna 150 does not transmit a separate microwave and is used for symmetric electric field distribution and impedance matching.

The reflection plate 120 may be a dielectric material disposed at the boundary between the bottom resonant cavity 112 and the top resonant cavity 114. The reflection plate 120 has a through-hole 120*a* formed in its center, and the bottom pillar 134 may extend through the through-hole 120*a* of the reflection plate 120. One side of the reflection plate 120 facing the discharge bulb 130 may have a dielectric multilayer reflective structure to reflect light emitted from the discharge bulb 130.

Figure 3A:
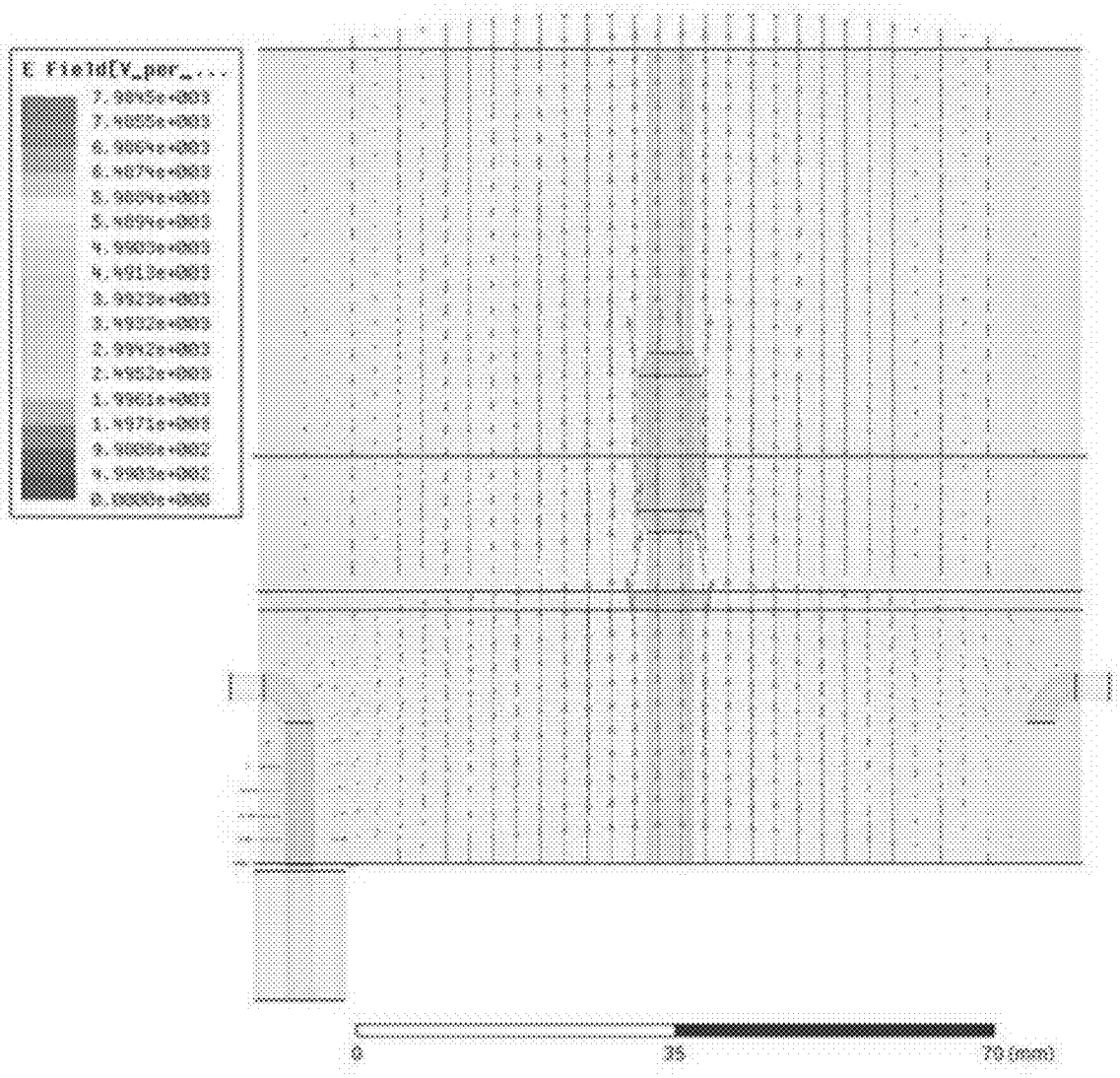
FIG. 3A illustrates a result indicating a direction of an electric field on an xz plane of a resonant cavity.

FIG. 3A illustrates a result indicating a direction of an electric field on an xz plane of a resonant cavity.

Figure 3B:
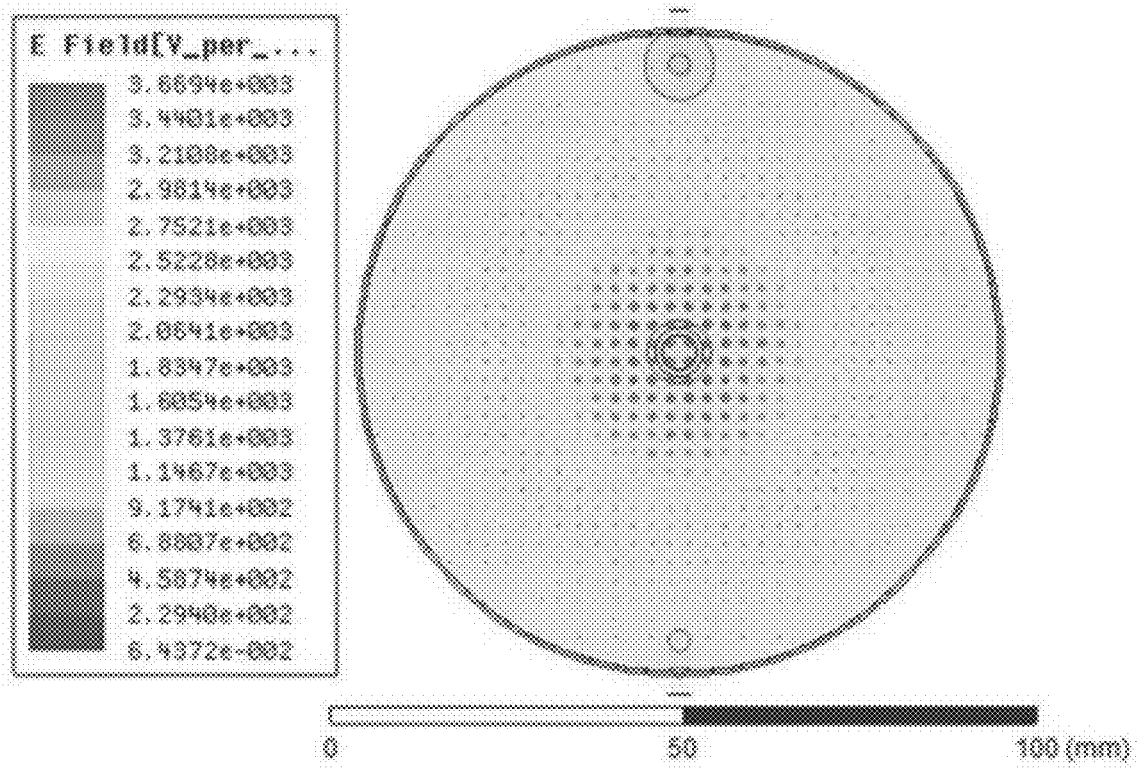
FIG. 3B illustrates a result indicating a direction of an electric field on an xy plane of the resonant cavity.

FIG. 3B illustrates a result indicating a direction of an electric field on an xy plane of the resonant cavity.

Figure 3C:
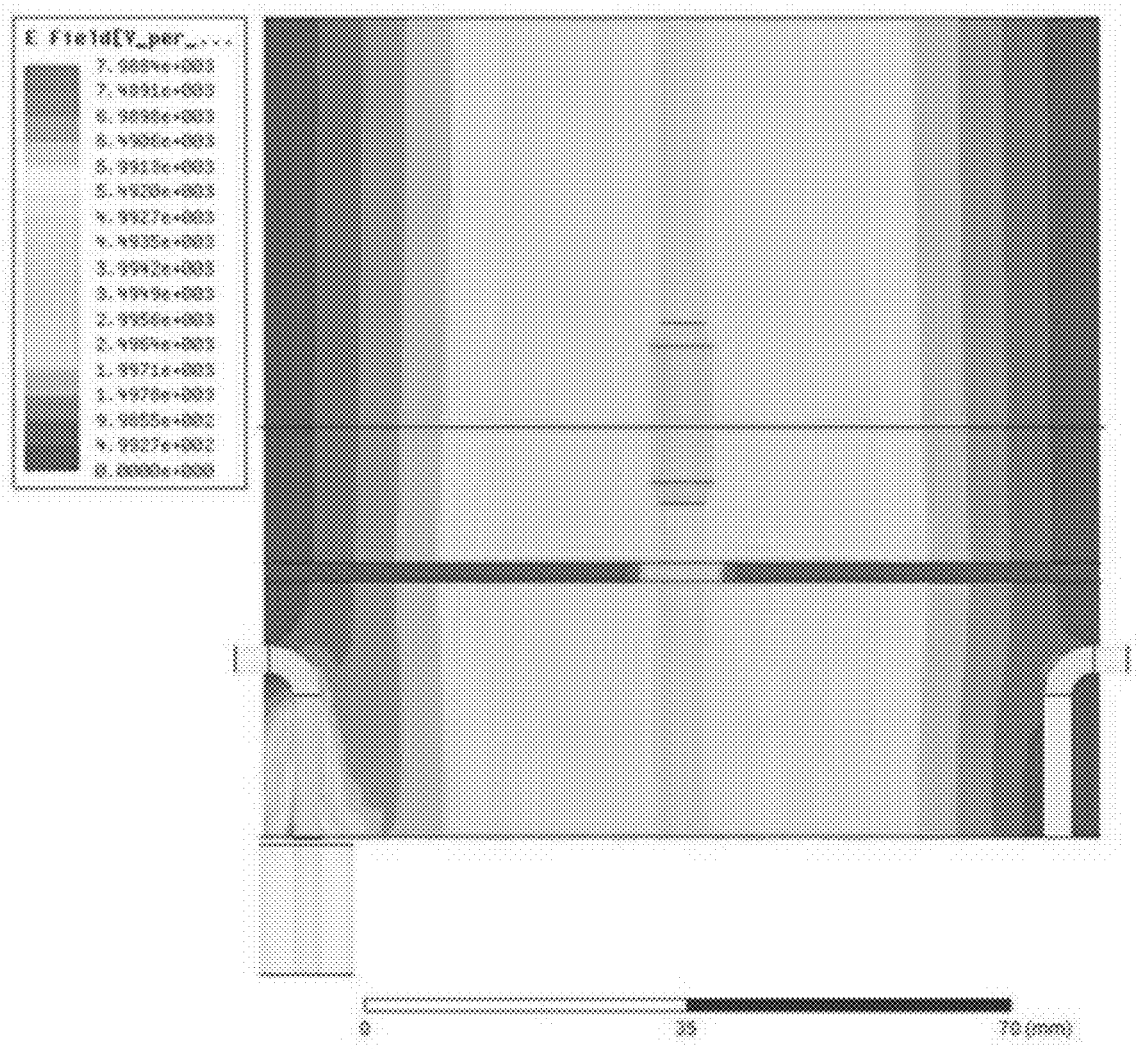
FIG. 3C illustrates a result indicating a z-axis component of an electric field on the xz plane of the resonant cavity.

FIG. 3C illustrates a result indicating a z-axis component of an electric field on the xz plane of the resonant cavity.

Figure 3D:
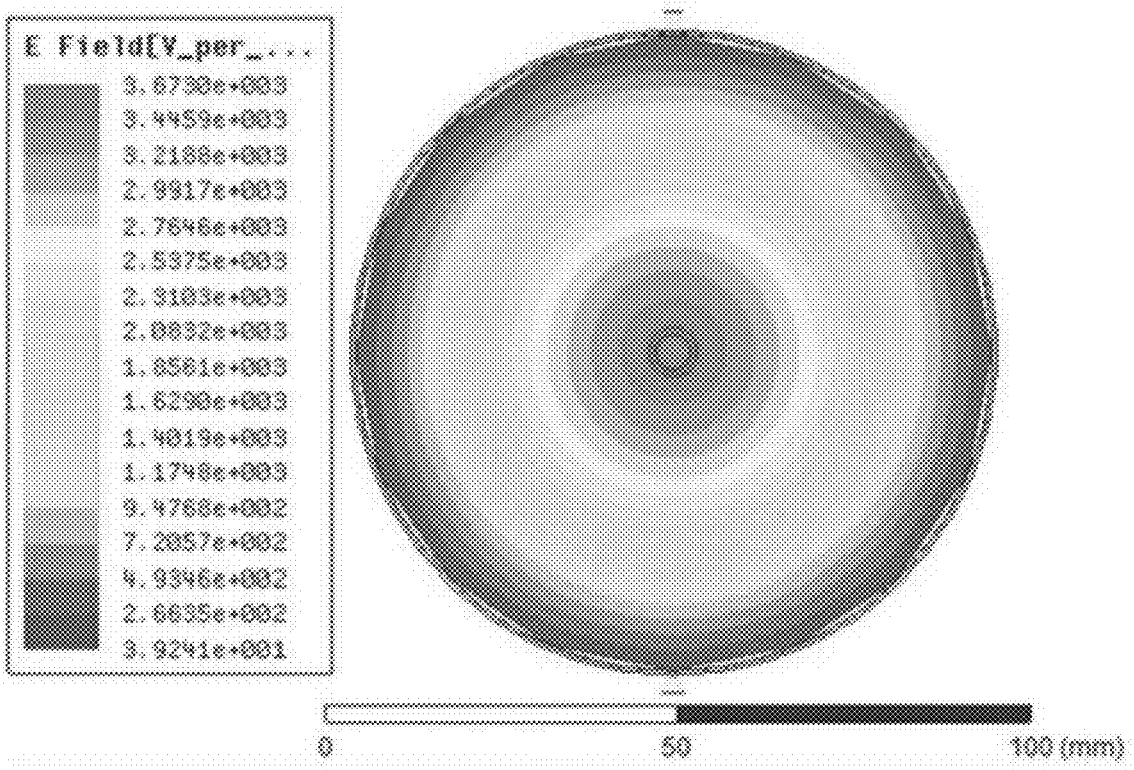
FIG. 3D illustrates a result indicating a z-axis component of an electric field on the xy plane of the resonant cavity.

FIG. 3D illustrates a result indicating a z-axis component of an electric field on the xy plane of the resonant cavity.

Figure 3E:
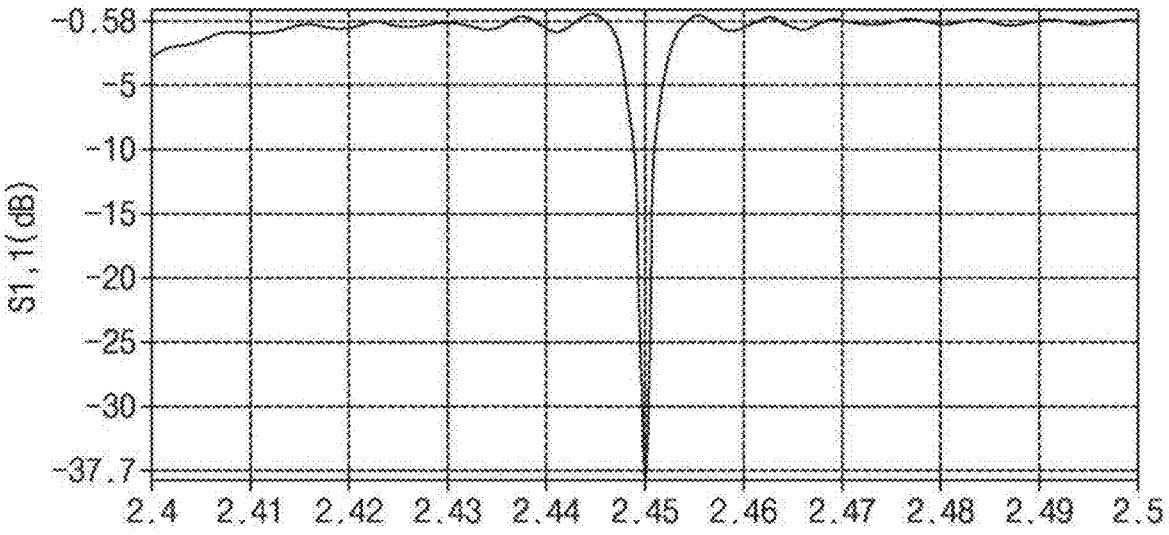
FIG. 3E is a graph depicting a frequency-dependent reflection coefficient S(1,1).

FIG. 3E is a graph depicting a frequency-dependent reflection coefficient S(1,1).

Referring to FIGS. 3A to 3E, simulation results are shown to describe the circular TM010 mode. A length of a resonant cavity is 90 mm, a diameter of the resonant cavity is 91 mm, and a diameter of a cylindrical discharge bulb is 5 mm. An impedance and a pattern of an electric field vary depending on whether a reflection plate exists. The reflection plate is disposed at a position of 28 mm from a bottom surface of the resonant plate, a thickness of the reflection plate is 2 mm, and a material of the reflection plate is quartz. An electric conductivity in a discharge bulb is 0.1 S/m.

At 2.495 GHz, a reflection loss ($20 \log_{10}(S(1,1))$) has −35.7 dB and a pattern of an electric field has a symmetrical form.

A size and an electric conductivity of the discharge bulb have a great influence on oscillation of circular TM010. When a diameter of the discharge bulb increases to more than 15 mm, a reflection coefficient increases and it is difficult to obtain stable oscillation of the circular TM010 mode.

Figure 4:
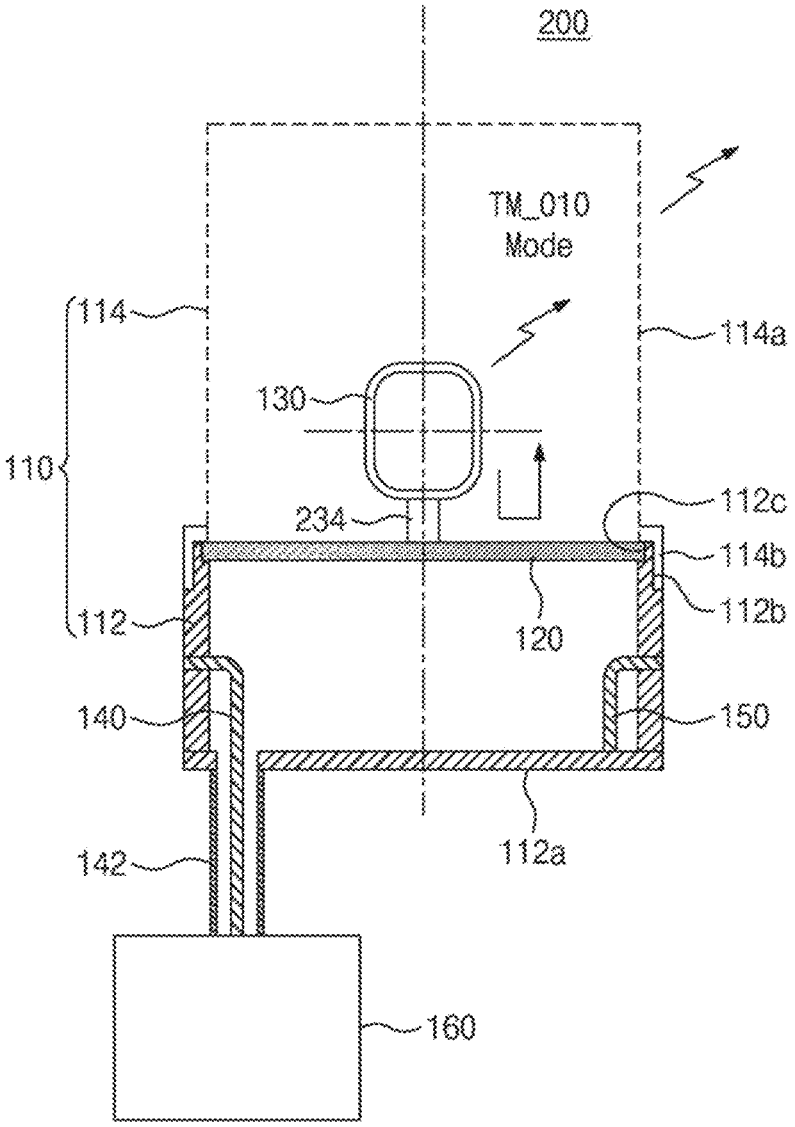
FIG. 4 is a cross-sectional view illustrating a microwave discharge lamp according to another example embodiment of the present disclosure.

FIG. 4 is a cross-sectional view illustrating a microwave discharge lamp according to another example embodiment of the present disclosure.

Referring to FIG. 4, a microwave discharge lamp 200 includes a discharge bulb 130 which is discharged by a microwave and emits a light, a cylindrical resonant cavity 110 which has at least a portion formed of a conductive mesh of net structure and is disposed to cover the discharge bulb 130, a main antenna 140 which has one end supplied with microwave power through a bottom surface of the resonant cavity 110 and the other end electrically contacting a side surface of the resonant cavity 110 to be grounded, and a dummy antenna 150 which has one end electrically grounded to the bottom surface of the resonant cavity 110 and the other end electrically grounded to the side surface of the resonant cavity 110 and is disposed opposite to the main antenna 140 to be symmetrical to the main antenna 140 about a central axis of the resonant cavity 110.

The discharge bulb 130 may include a bottom pillar 234 which extends in a central axis direction of the resonant cavity 110 to be connected to the center of a reflection plate 120.

One end of the bottom pillar 234 may be formed of the same material as the discharge bulb 130 and be fused to a lower portion of the discharge bulb 130, and the other end of the bottom pillar 234 may be fused to the center of a reflection plate 120.

The reflection plate 120 may be a dielectric material disposed at the boundary between a bottom resonant cavity 112 and the top resonant cavity 114. The reflection 120 may have a through-hole formed in its center, and the bottom pillar 134 may be coupled with the center of the reflection plate 120. One side of the reflection plate 120 facing the discharge bulb 130 may have a dielectric multilayer reflective structure to reflect light emitted from the discharge bulb 130.

Figure 5:
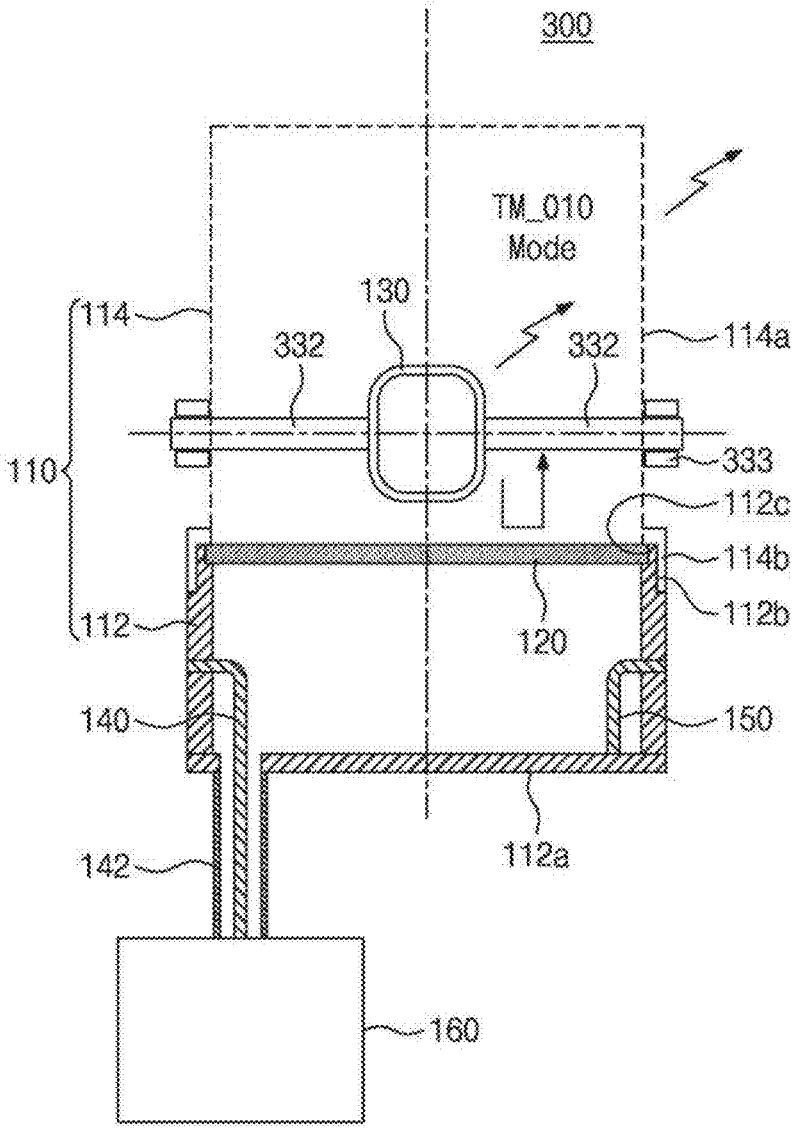
FIG. 5 is a cross-sectional view illustrating a microwave discharge lamp according to another example embodiment of the present disclosure.

FIG. 5 is a cross-sectional view illustrating a microwave discharge lamp according to another example embodiment of the present disclosure.

Referring to FIG. 5, a microwave discharge lamp 300 includes a discharge bulb 130 which is discharged by a microwave and emits a light, a cylindrical resonant cavity 110 which has at least a portion formed of a conductive mesh of net structure and is disposed to cover the discharge bulb 130, a main antenna 140 which has one end supplied with microwave power through a bottom surface of the resonant cavity 110 and the other end electrically contacting a side surface of the resonant cavity 110 to be grounded, and a dummy antenna 150 which has one end electrically grounded to the bottom surface of the resonant cavity 110 and the other end electrically grounded to the side surface of the resonant cavity 110 and is disposed opposite to the main antenna 140 to be symmetrical to the main antenna 140 about a central axis of the resonant cavity 110.

The discharge bulb 130 may include a plurality of support pillars 332 which extend in a radial direction of the resonant cavity 110 to be coupled with a side surface of a top resonant cavity 114. The support pillars 332 may be arranged at intervals of 120 degrees or 90 degrees. One end of each of the support pillars 332 may be fused to the discharge bulb 130, and the other end of each of the support pillars 332 may be inserted in a hole formed at the top resonant cavity 114 and be fixed using a fixing member 333 such as a nut.

One end of a bottom pillar 234 may be formed of the same material as the discharge bulb 130 and be fused to a lower portion of the discharge bulb 130, and the other end of the bottom pillar 234 may be fused to the center of a reflection plate 120.

Figure 6:
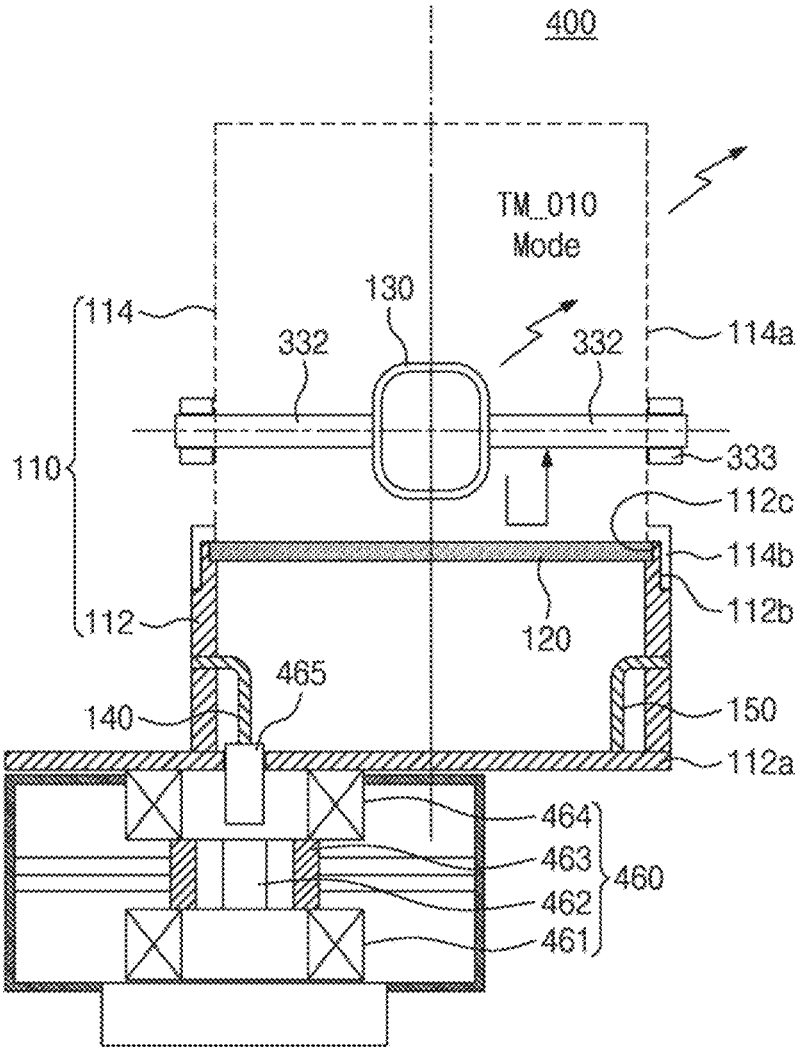
FIG. 6 is a cross-sectional view illustrating a microwave discharge lamp according to another example embodiment of the present disclosure.

FIG. 6 is a cross-sectional view illustrating a microwave discharge lamp according to another example embodiment of the present disclosure.

Referring to FIG. 5, a microwave discharge lamp 400 includes a discharge bulb 130 which is discharged by a microwave and emits a light, a cylindrical resonant cavity 110 which has at least a portion formed of a conductive mesh of net structure and is disposed to cover the discharge bulb 130, a main antenna 140 which has one end supplied with microwave power through a bottom surface of the resonant cavity 110 and the other end electrically contacting a side surface of the resonant cavity 110 to be grounded, and a dummy antenna 150 which has one end electrically grounded to the bottom surface of the resonant cavity 110 and the other end electrically grounded to the side surface of the resonant cavity 110 and is disposed opposite to the main antenna 140 to be symmetrical to the main antenna 140 about a central axis of the resonant cavity 110.

A microwave power supply 460 may be a magnetron. The magnetron may include a top magnet 464, a bottom magnet 461, an anode 463, a cathode 461, and a dipole antenna 465. The cathode 461 of the magnetron emits thermal electrons, and the electrons are accelerated to the anode 463 at high speed by a voltage applied to the grounded anode 463 to emit electromagnetic waves.

Figure 7:
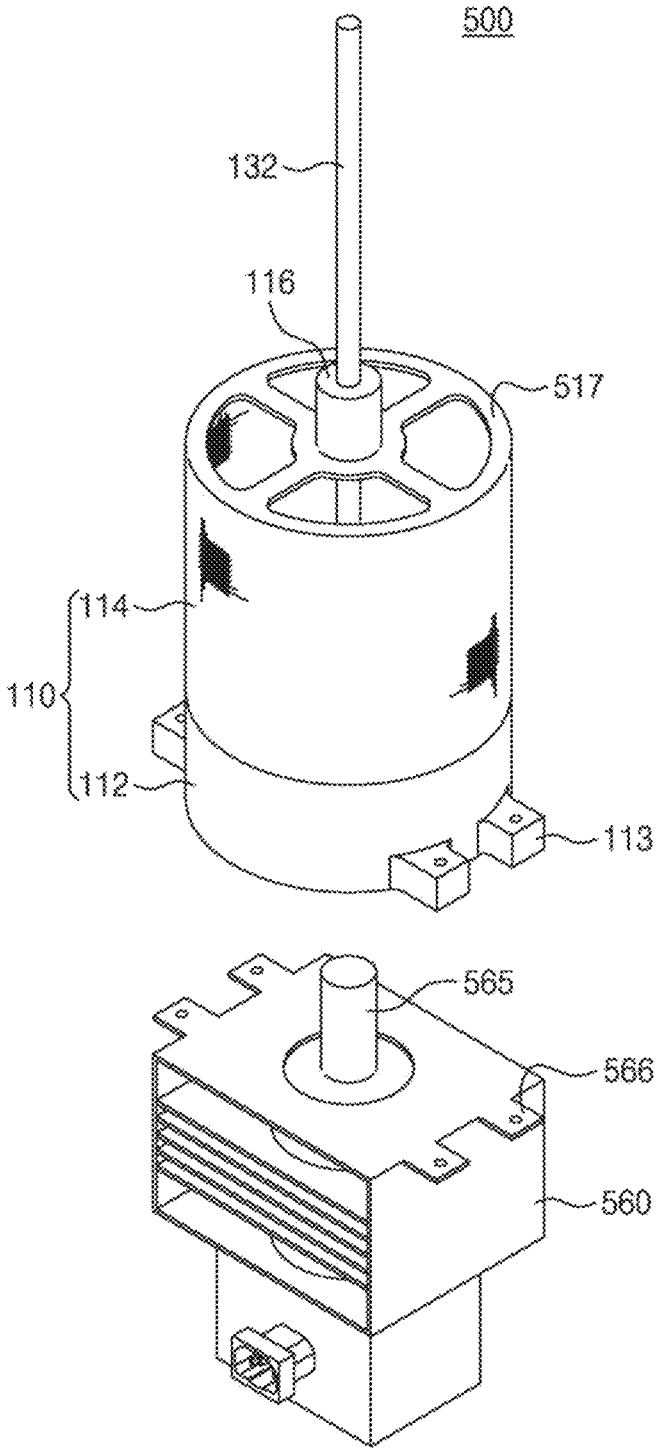
FIG. 7 is a cross-sectional view illustrating a microwave discharge lamp according to another example embodiment of the present disclosure.

FIG. 7 is a cross-sectional view illustrating a microwave discharge lamp according to another example embodiment of the present disclosure.

Figure 8:
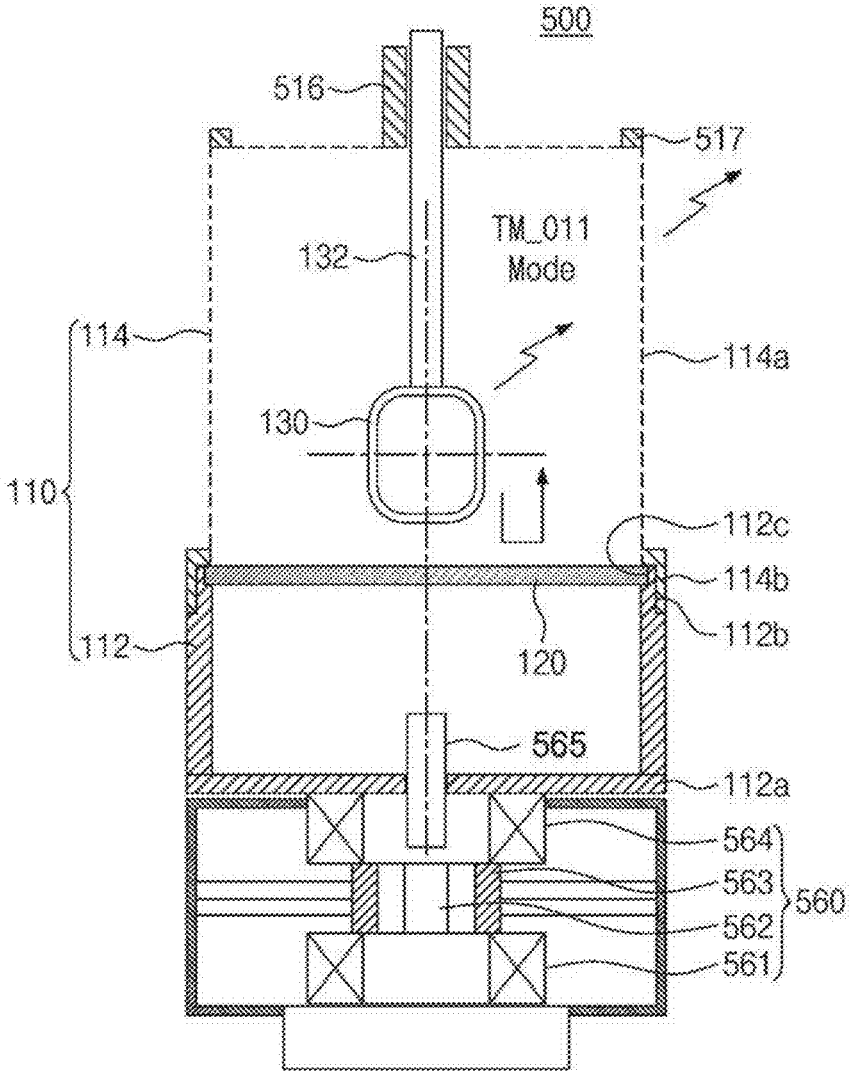
FIG. 8 is a cross-sectional view of the microwave discharge lamp in FIG. 7.

FIG. 8 is a cross-sectional view of the microwave discharge lamp in FIG. 7.

Figure 9:
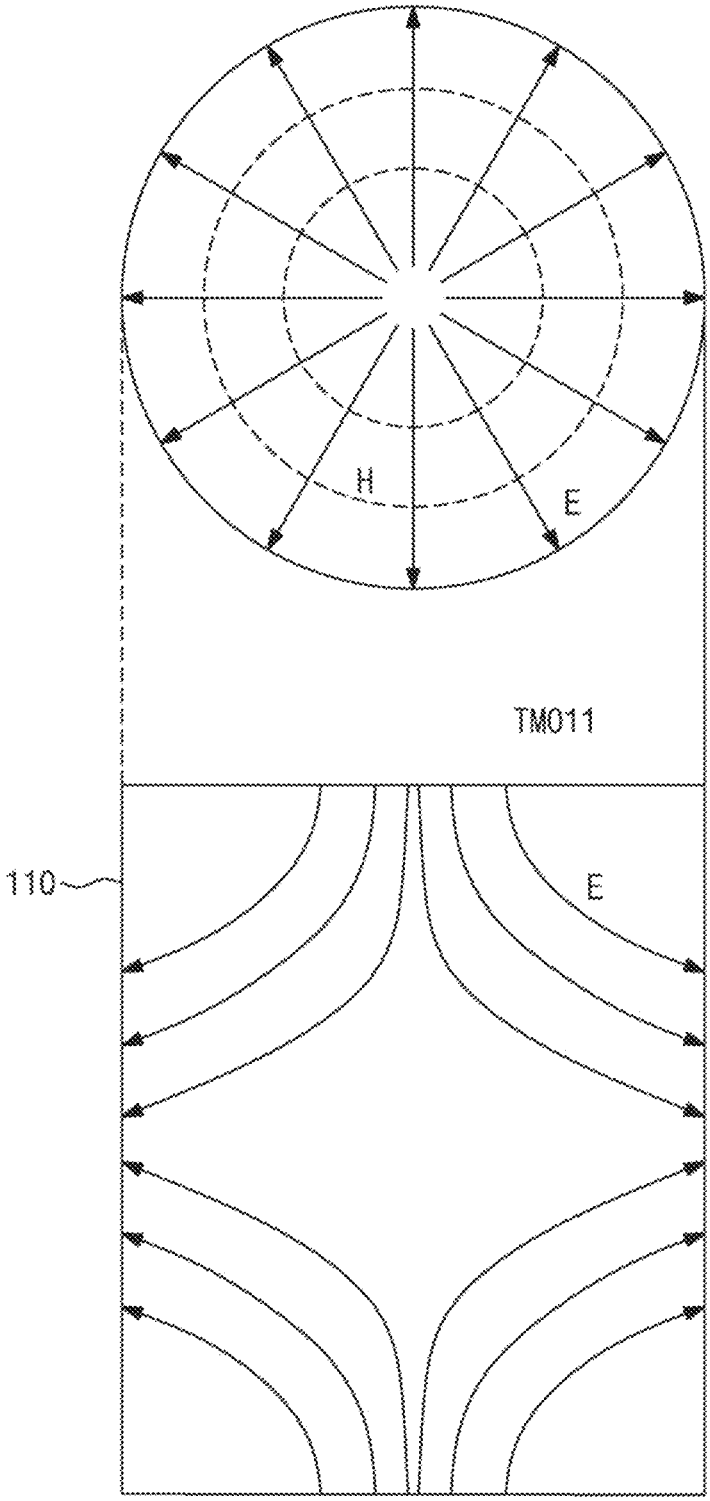
FIG. 9 illustrates a circular TM011 mode of the microwave discharge lamp in FIG. 7.

FIG. 9 illustrates a circular TM011 mode of the microwave discharge lamp in FIG. 7.

Referring to FIGS. 7, 8, and 9, a microwave discharge lamp 500 includes a discharge bulb 130 which is discharged by a microwave and emits a light, a cylindrical resonant cavity 110 which has at least a portion formed of a conductive mesh of net structure and is disposed to cover the discharge bulb 130, and a microwave generator 560 which directly radiates a microwave to the center of a bottom surface of the resonant cavity 110. The resonant cavity 110 includes a bottom resonant cavity 112 whose bottom surface has the center in which an antenna of the microwave generator 560 is inserted and which is formed of a conductive material and has an opened top surface and a top resonant cavity 114 which is coupled with a top surface of the bottom resonant cavity 112 and has a side surface and a top surface formed of a conductive mesh. The resonant cavity 110 may create a circular TM011 mode.

The resonant cavity of the present disclosure may be changed to create a circular TM010 mode.

The microwave generator 560 may be a magnetron. The magnetron may include a top magnet 564, a bottom magnet 561, an anode 563, a cathode 561, and a dipole antenna 565. The cathode 561 of the magnetron emits thermal electrons, and the electrons are accelerated to the anode 563 at high speed by a voltage applied to the grounded anode 563 to emit electromagnetic waves. The magnetron may include a coupling portion 566 disposed on its top surface to be fixedly coupled with the resonant cavity 110. The coupling portion 566 may be coupled with a protrusion 113 which protrudes to the outer side from the bottom surface of the resonant cavity 110.

The resonant cavity 110 may create the circular TM011 mode. The resonant cavity may be generally cylindrical. The resonant cavity 110 may include the bottom resonant cavity 112 which is formed of a conductive material and has an opened top surface and the top resonant cavity 114 which is coupled with the top surface of the bottom resonant cavity 112 and has a side surface and a top surface formed of a conductive mesh. A length of the top resonant cavity 114 may be half or threw quarters of the whole length H of the resonant cavity 110. The whole length H of the resonant cavity 110 may be 90 mm. A diameter of the resonant cavity 110 may be 91 mm. A length of the top resonant cavity 114 may be 62 mm. The length of the resonant cavity 110 may vary depending on a bulb, an antenna, and the like.

The top resonant cavity 114 may include a cylindrical conductive ring 114*b* which is formed of a conductive material and is inserted in an outer circumferential surface of the bottom resonant cavity 114 to be in electric contact with the bottom resonant cavity 114 and a mesh cylinder 114*a* coupled with the conductive ring 114*b*. A side surface and a top surface of the mesh cylinder 114*a* may be formed of a mesh or a porous sheet material to electrically constitute the resonant cavity 110 and transmit a light emitted from the discharge bulb 130. A lower side of the mesh cylinder 114*a* may be fixed to the conductive ring 114*b* through welding or the like.

The bottom resonant cavity 112 may be in the form of a metallic cylinder and have an outer step 112*b* formed on a top outer surface and an inner step 112*c* formed on a top inner surface. The outer step 112*b* may be inserted in a lower portion of the top resonant cavity 114. A height of the bottom resonant cavity 112 may be 28 mm. A dielectric reflection plate 120 may be disposed at the inner step 112*c*. A bottom surface 112*a* of the bottom resonant cavity 112 is closed. The reflection plate 120 may reflect a light, which impinges on the reflection plate 120 after being reflected from the discharge bulb 130, in a direction of the top resonant cavity 114.

The discharge bulb 130 may be elliptical, spherical or cylindrical. The discharge bulb 130 may be a transparent dielectric. For example, The discharge bulb 130 may be formed of quartz filling a discharge material therein. The discharge material may include at least one of sulfur, selenium, mercury, and metal halide. The discharge material may further include a buffer gas such as an argon gas. When the discharge bulb 130 is cylindrical, a diameter of the discharge bulb 130 may be 5 mm.

The discharge bulb 130 may include a top pillar 132 extending in a central axis direction of the top resonant cavity 100 to be fixed to atop surface of the top resonant cavity 114. The top pillar 132 may be formed of the same material as the discharge bulb 130 and be fused to an upper portion of the discharge bulb 130. The top pillar 132 may be inserted in a support 116, which extends in the center of the top surface of the top resonant cavity 114 in a central axis direction, to be fixed. A lower end of the bottom pillar 134 may be inserted in a groove, which is formed in the center of the bottom surface of the bottom resonant cavity 112, to be aligned.

The support 116 may include an auxiliary support 517 which is disposed on a top surface of the top resonant cavity 114 and radially branches to support the support 116. The auxiliary support 517 may include a circular ring to fix a radially branching portion.

A reflection plate 120 may be a dielectric material disposed at the boundary between the bottom resonant cavity 112 and the top resonant cavity 114. The reflection plate 120 has a through-hole 120*a* formed in its center, and the bottom pillar 134 may extend through the through-hole 120*a* of the reflection plate 120. One side of the reflection plate 120 facing the discharge bulb 130 may have a dielectric multilayer reflective structure to reflect light emitted from the discharge bulb 130.

The microwave generator 560 may be change to a solid-state microwave generator including an antenna.

According to modified embodiments of the present disclosure, a support pillar supporting the discharge bulb 130 may be transformed, as described in FIGS. 5 and 6.

As described above, a microwave discharge lamp according to an example embodiment of the present disclosure includes a loop antenna which is directly inserted in a resonant cavity to oscillate a circular TM010 mode or a circular TM011 mode. As a result, discharge efficiency may be improved and a component such as a waveguide may be removed to reduce the volume of the microwave discharge lamp.

Although the present disclosure and its advantages have been described in detail, it should be understood that various changes, substitutions and alterations can be made herein without departing from the spirit and scope of the disclosure as defined by the following claims.

What is claimed is:

1. A microwave discharge lamp comprising:

a discharge bulb which is discharged by a microwave and emits a light;

a cylindrical resonant cavity which has at least a portion formed of a conductive mesh of net structure and is disposed to cover the discharge bulb;

a main antenna which has one end supplied with microwave power through a bottom surface of the resonant cavity and the other end electrically contacting a side surface of the resonant cavity to be grounded; and a dummy antenna which has one end electrically grounded to the bottom surface of the resonant cavity and the other end electrically grounded to the side surface of the resonant cavity and is disposed opposite to the main antenna to be symmetrical to the main antenna about a central axis of the resonant cavity.

2. The microwave discharge lamp as set forth in claim 1, wherein the resonant cavity comprises:

a bottom resonant cavity which has a bottom surface into which the main antenna is inserted, is formed of a conductive material, and has an opened top surface; and a top resonant cavity which is coupled with the top surface of the bottom resonant cavity and has a side surface and a top surface formed of a conductive mesh, and the discharge bulb is disposed at the top resonant cavity.

3. The microwave discharge lamp as set forth in claim 2, wherein the discharge bulb comprises:

a top pillar extending in a center direction of the top resonant cavity to be fixed to the top resonant cavity; and a bottom pillar extending in a center direction of the bottom resonant cavity to be fixed to the bottom resonant cavity.

4. The microwave discharge lamp as set forth in claim 2, further comprising:

a reflection plate disposed at the boundary between the top resonant cavity and the top resonant cavity, wherein the reflection plate has a through-hole formed in its center, the bottom pillar extends through the through-hole of the reflection plate, and one side of the reflection plate facing the discharge bulb has a dielectric multilayer reflective structure to reflect light emitted from the discharge bulb.

5. The microwave discharge lamp as set forth in claim 2, wherein the top resonant cavity comprises:

a cylindrical conductive ring which is formed of a conductive material and is inserted in an outer circumferential surface of the bottom resonant cavity to be in electric contact with the bottom resonant cavity; and a mesh cylinder which is fixed to the conductive ring.

6. The microwave discharge lamp as set forth in claim 1, further comprising:

a microwave power supply which supplies microwave power to the main antenna; and a transmission line of a coaxial cable structure which transmits the microwave power of the microwave power supply to the main antenna.

7. The microwave discharge lamp as set forth in claim 1, wherein the resonant cavity provides a circular TM010 mode or a circular TM011 mode.

8. The microwave discharge lamp as set forth in claim 1, wherein a frequency band of the microwave is 2.45±0.05 GHz.

9. The microwave discharge lamp as set forth in claim 1, wherein the discharge bulb is cylindrical or elliptical.

10. A microwave discharge lamp comprising:

a discharge bulb which is discharged by a microwave and emits a light;

a cylindrical resonant cavity which has at least a portion formed of a conductive mesh of net structure and is disposed to cover the discharge bulb; and a microwave generator which directly radiates a microwave to the center of a bottom surface of the resonant cavity, wherein the resonant cavity comprises:

a bottom resonant cavity whose bottom surface has the center in which an antenna of the microwave generator is inserted and which is formed of a conductive material and has an opened top surface; and a top resonant cavity which is coupled with a top surface of the bottom resonant cavity and has a side surface and a top surface formed of a conductive mesh.

11. The microwave discharge lamp as set forth in claim 10, wherein the microwave generator is a magnetron.

12. The microwave discharge lamp as set forth in claim 10, wherein the resonant cavity creates a circular TM010 mode or a circular TM011 mode.

13. The microwave discharge lamp as set forth in claim 10, wherein the discharge bulb comprises:

a top pillar extending in a center direction of the top resonant cavity to be fixed to the top resonant cavity; and a bottom pillar extending in a center direction of the bottom resonant cavity to be fixed to the bottom resonant cavity.

14. The microwave discharge lamp as set forth in claim 10, further comprising:

reflection plate disposed at the boundary between the top resonant cavity and the top resonant cavity, wherein the reflection plate has a through-hole formed in its center, the bottom pillar extends through the through-hole of the reflection plate, and one side of the reflection plate facing the discharge bulb has a dielectric multilayer reflective structure to reflect light emitted from the discharge bulb.

15. The microwave discharge lamp as set forth in claim 10, wherein the top resonant cavity comprises:

a cylindrical conductive ring which is formed of a conductive material and is inserted in an outer circumferential surface of the bottom resonant cavity to be in electric contact with the bottom resonant cavity; and a mesh cylinder which is fixed to the conductive ring.

* * * * *